United States Patent [19]

Aprea et al.

[11] Patent Number: 4,474,331

[45] Date of Patent: Oct. 2, 1984

[54] RECESSED CENTER VANE FOR FULL CONE NOZZLE

[75] Inventors: George F. Aprea, Dedham; Werner P. Pohle, Lynn, both of Mass.

[73] Assignee: Wm. Steinen Mfg. Co., Parsippany, N.J.

[21] Appl. No.: 424,345

[22] Filed: Sep. 27, 1982

[51] Int. Cl.[3] ..... B05B 1/34

[52] U.S. Cl. ..... 239/488; 239/491

[58] Field of Search ..... 239/486–491, 239/493, 494, 496, 497, 463

[56] References Cited

U.S. PATENT DOCUMENTS

| | | | |
|---|---|---|---|
| 1,982,840 | 12/1934 | Sweetland | 239/494 |
| 2,845,304 | 7/1958 | Stelma et al. | 239/497 |
| 3,275,248 | 9/1966 | O'Brien et al. | 239/489 |
| 3,344,558 | 10/1967 | Kirkland | 239/488 |
| 4,406,407 | 9/1983 | Aprea et al. | 239/487 |

FOREIGN PATENT DOCUMENTS

| | | | |
|---|---|---|---|
| 1050589 | 3/1979 | Canada | 239/487 |

*Primary Examiner*—John J. Love
*Assistant Examiner*—Jon M. Rastello
*Attorney, Agent, or Firm*—Ostrolenk, Faber, Gerb & Soffen

[57] ABSTRACT

A novel center vane is disclosed for use in a full or solid cone spray nozzle. The vane has a solid center and specific parameters are set forth, in relation to the nozzle size and orifice diameter, for the vane geometry so that a solid spray cone of uniform distribution is obtained. In particular, we have found that when the orifice diameter is less than half of the nozzle diameter, the vane recess depth is a critical dimension to obtain a uniform fluid particle distribution in the solid cone spray and specifically have found that if the orifice diameter is equal to or greater than one-half the pipe or nozzle diameter, the vane recess depth should be one-fourth (0.25) of the pipe diameter, but if the orifice diameter is less than half of the pipe or nozzle diameter, the vane recess depth in inches should be equal to the orifice diameter squared divided by the nozzle diameter.

14 Claims, 8 Drawing Figures

FIG. 1.
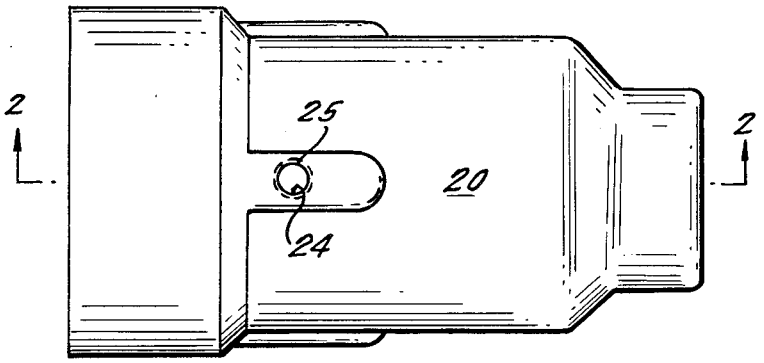
FIG. 2.
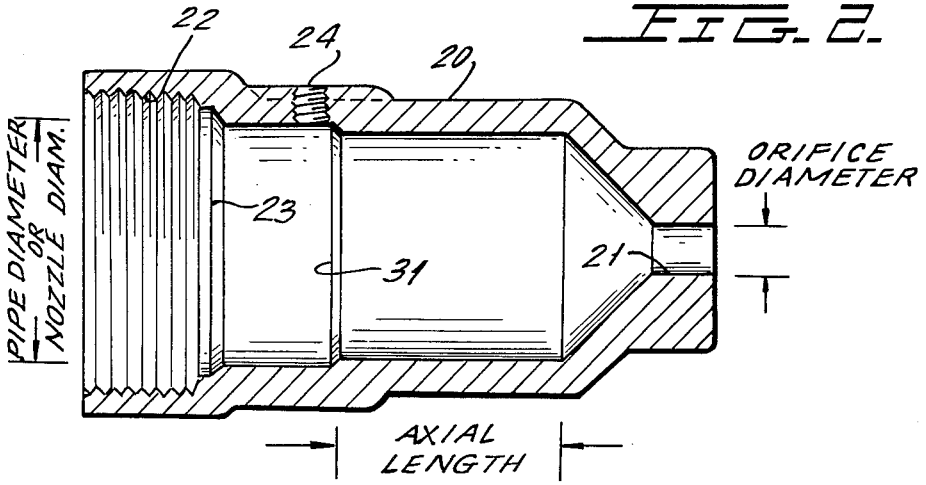
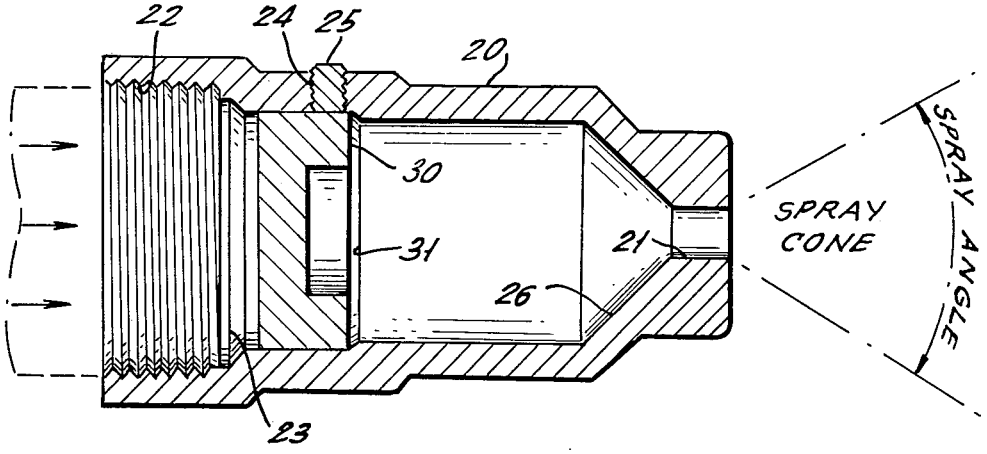
FIG. 3.

FIG. 6.
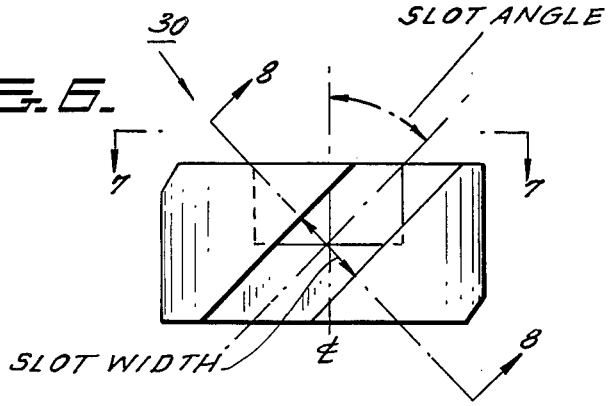
FIG. 5.
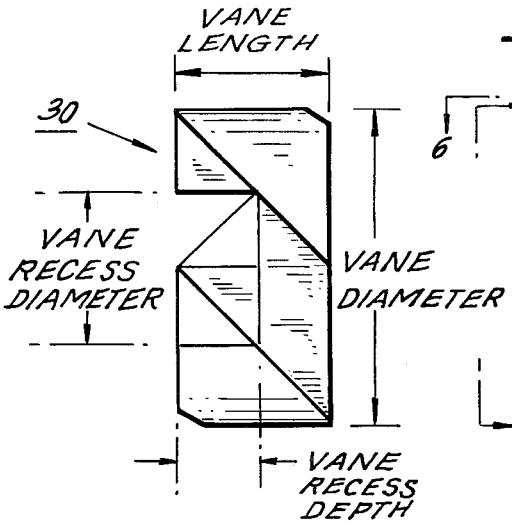
FIG. 4.
INPUT FACE
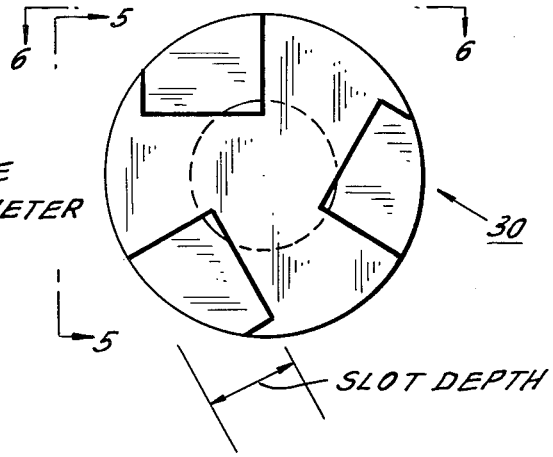
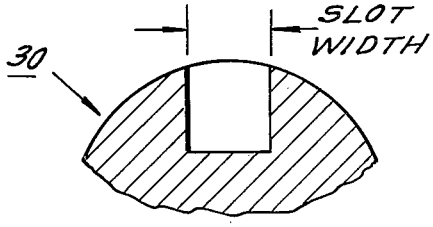
FIG. 8.
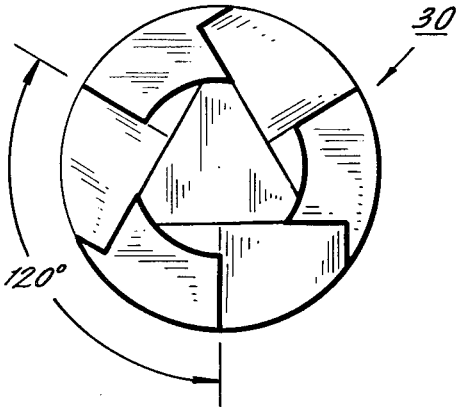
FIG. 7.
OUTPUT FACE

RECESSED CENTER VANE FOR FULL CONE NOZZLE

BACKGROUND OF THE INVENTION

This invention relates to a recessed center vane of a straight-through solid cone spray nozzle. Straight-through spray nozzles with a solid cone spray are old and well known in the art as shown, for example, in co-pending U.S. patent application Ser. No. 322,169 filed Nov. 17, 1981 and issued on Sept. 27, 1983 as U.S. Pat. No. 4,406,407 entitled "High Flow Low Energy Solid Jet Nozzle" and assigned to the assignee of the present invention. Straight-through solid cone nozzles are also commercially available as, for example, by Wm. Steinen Mfg. Co. of Parsippany, N.J., the assignee of the present application.

Solid cone nozzles commonly comprise a straight-through nozzle body having an input chamber which is connected to a fluid-connecting conduit of given diameter and flow capacity for fluids at a given pressure. A center vane is placed in the input chamber of the nozzle body and communicates between the input section and an axial discharge orifice of the nozzle body. The center vane commonly is provided with a plurality of slots which differ in number, angular configuration and size depending upon the desired end use. It is desirable to design the unit so that the fluid flow per unit of time at any unit area across the cone is as uniform as possible relative to other unit area in the same plane across the cone and thus maintain a solid spray cone.

In the past, the vane for the spray nozzle was custom-made for a particular application to obtain a solid spray cone under given conditions of input pipe size, input pressure and volumetric fluid flow. It was not possible to simply change the scale of a given vane design when going from one input pipe size to another or from one input pressure to another because the resulting spray pattern would no longer be uniform and generally would become hollow or otherwise unsuitable. Thus a new vane design was required for each set of new pressure, volumetric flow and pipe diameter parameters. These vane designs are time-consuming since they are generally reached only after considerable trial and error methods and the cost of the resulting nozzle is substantially increased.

Parameters of the vane design which can be changed include the vane thickness, changes in the number of slots or channel openings and their location, changes in the angular relationship of the slot to the axis of the vane, changes in the cross-sectional geometry of the slot or channel openings through the vane and changes in the depth of the vane recess. For example, in the past, when the flow rate was increased, the vane design would be commonly modified by increasing the number of slots through the vane and/or by increasing slot width. Care had to be taken, however, since, if the slots became too wide or too numerous, fluid distribution over the area of the spray cone was poor. Similarly, if the number of slots became too great, the individual slot cross-sectional area was smaller and the slots were easily clogged by particulates carried in the fluid. Care also had to be taken during the design not to have the slots so large that the webs between the slots within the vane were structurally weakened to the point where they could easily fail during manufacture or in operation.

Care also had to be taken to ensure against forming a hollow spray cone pattern.

This invention relates to full cone spray nozzles having substantially even distribution of the liquid throughout the entire cross-sectional spray pattern, as contrasted with hollow cone sprays where no liquid is present in the center portion of the spray.

As previously noted, full cone spray nozzles are well known in the art, and are comprised of a nozzle body with an internal chamber having an input end into which liquid can be introduced and a reduced diameter axial discharge orifice at the other end of the chamber. Within the chamber and spaced from the discharge orifice, a center vane means is provided so that liquid passing through the chamber has a swirling or rotative motion applied thereto coupled with a controlled amount of turbulence. When the liquid is discharged from the orifice, the liquid assumes a conical form and should have uniform distribution of the particles of fluid throughout the transverse cross-sectional area of the spray.

In full cone spray nozzles, the capacity is determined by the cross-sectional area of discharge orifice and the operating pressure. In order to achieve uniformity of particle distribution in the spray, the dimensional relationships between the orifice of the center vane and the internal chamber constitute variables that contribute and interact in attaining the desired results. Full cone spray nozzles have a wide field of usefulness and there are large numbers of nozzles that are commercially available to provide nozzles having the desired combination of capacity, spray angle and pressure to satisfy the majority of design situations. There may be at least 40 different nozzle sizes at 40 pounds per square inch liquid pressure to provide capacities of from one (1) gallon per minute to 15,000 gallons per minute with spray angles ranging between 20° and 140°.

In accordance with the invention, a novel center vane geometry has been produced which has been found to form a uniform solid cone spray for a wide range of pipe diameters, volumetric flow and input fluid pressures.

The vane geometry of the invention applies to pipes of any diameter from one-eighth (0.125) inch to 24 inches employing input pressures of from 1 p.s.i. to 150 p.s.i. and requiring a flow of between 1 to 15,000 gallons per minute.

The novel design of the invention was reached through extensive experimentation and trial and error which revealed the following relationships which must be maintained in the vane design to retain a solid spray cone:

(1) The number of channel slots employed for the center vane is three (3). Each slot is spaced 120° from the other and has a generally rectangular cross-section including a flat bottom.

(2) The slots are placed at an angle to the axis of the vane. For a precise design, the angle could be one-half the desired exit or spray angle, where the slot angle is measured between the center line axis of the vane and a line extending along the center of the bottom of each slot. However, we have found that the 45° angle, for the most popular spray angle of 90°, could be retained and an adjustment in the exit flare of the nozzle could be made to adjust for larger or smaller spray angles.

(3) Each slot has a width equal to one-fourth (0.25) of the nozzle diameter and a depth equal to nozzle diameter divided by the number of slots, i.e. three (3).

(4) The vane length, measured along the vane axis, is equal to one-half (0.5) the nozzle diameter and the vane diameter is equal to the pipe or nozzle diameter.

(5) The vane is spaced from the orifice by a distance equal to the diameter of the vane or diameter of the nozzle.

(6) The total inlet opening area of the vane is substantially less than the outlet opening area of the vane. This is accomplished by having a recess cut into the outlet end of the vane. This recess permits the creation of a solid cone spray and by properly relating the depth of the recess in the vane to the orifice diameter, it is possible to have a substantially uniform distribution of particles in the full cone spray.

The novel combination of the nozzle and recessed center vane produces a swirling motion or controlled turbulence of fluid as it flows through the vane and nozzle body and before entering the discharge orifice. When the liquid is discharged through the orifice as a spray, the spray forms a solid cone having a very uniform distribution throughout the transverse cross-sectional area of the cone. When the pipe diameter is changed, the vane diameter is proportionally changed and the above geometrical relationships for the channel or slot openings through the vane are maintained and the same desired uniform solid spray cone will still be produced. Similarly, when input fluid pressure or fluid flow rate is changed for the same or for different pipe diameters, the novel solid cone configuration of uniform distribution is maintained. By a controlled relation between the vane recess depth and the orifice opening, a very uniform distribution of solid spray can be obtained.

The novel vane structure of the invention can be made from any desired material including metals and plastics. A typical metal is steel and a typical plastic is polyvinyl chloride. The conduit to which the nozzle is connected can be of any desired material and may be of metal such as steel or plastic such as polyvinyl chloride.

It is an object of the present invention to provide a full cone spray nozzle which maintains a desired capacity and ensures the uniform distribution of the liquid within the full cone spray.

Another object is to ensure equal distribution of liquid in a full cone by having a novel recessed center vane.

BRIEF DESCRIPTION OF THE DRAWINGS

FIG. 1 is a plan view of a nozzle body which may employ the recessed center vane of the present invention.

FIG. 2 is a cross-sectional view of FIG. 1 taken across the section lines 2—2 in FIG. 1.

FIG. 3 is a cross-sectional view similar to that of FIG. 2 but shows a recessed center vane in the nozzle body constructed in accordance with the principles of the present invention.

FIG. 4 is an elevational view of the input face of the center vane of the present invention.

FIG. 5 is a side view of FIG. 4 as seen from the line 5—5 in FIG. 4.

FIG. 6 is another side view of FIG. 4 as seen from the lines 6—6 in FIG. 4.

FIG. 7 is an elevation view of the output face of the center vane and is the view as seen from lines 7—7 of FIG. 6.

FIG. 8 is a partial cross-sectional view taken across the section lines 8—8 in FIG. 6, and illustrates the square shape of a slot or channel.

DETAILED DESCRIPTION OF THE DRAWINGS

Referring first to FIGS. 1, 2 and 3, there is shown a typical spray nozzle body 20 which may be a cast iron member which has been appropriately machined to contain an output orifice 21 in it output end and pipe-receiving threads 22 in its inlet end. The pipe-receiving threads 22 are adapted to receive any suitable fluid conduit which has male threads to cooperate with threads 22. The conduits received by threads 22 may be of metal or plastic. Body 20 may have a tapped opening 24 therein which receives a set screw 25 which is used to fix a center vane 30 in place and against locating shoulder 31. If desired, however, the vane 30 can be force-fit into body 20 to eliminate set screw 25. The structure of center vane 30 is the subject of this invention and will be described in connection with FIGS. 4 through 8.

The purpose of the assembly is to produce a solid spray cone as schematically shown by the dotted lines in FIG. 3. This spray cone is intended to have an equal distribution over its entire cross-sectional area which is relatively uniform. The center vane 30, which causes a twirling and turbulent action of the fluid which passes through openings in the vane 30, has a very substantial influence on the uniformity of distribution of spray over the area of the cone. In the past, this uniformity was usually disturbed when there were changes in the volumetric flow of fluid into body 20 and through the vane 30 and was also disturbed by changes in the pressure of the fluid at the input side of body 20.

The novel vane of the invention has been found to produce a very uniform distribution of spray throughout the cone angle within ranges, for example, of 20 solid degrees to 140 solid degrees of cone angle; for pressure variations of 1 p.s.i. to 150 p.s.i. of the input fluid; and mass flows, depending on orifice and pipe sizes and pressures, for example, 1 gallon per minute to 15,000 gallons per minute at 10 p.s.i.; and for input pipe diameters of ⅛ inch to 24 inches. Note that larger nozzles would be used at the lower pressures of the above ranges.

The novel center vane 30 shown in FIGS. 4, 5, 6 and 7 consists of a main body which can be of steel or other metal, ceramic, silicon plastics, such as polyvinyl chloride and the like. The outer diameter of the center vane 30 will be closely matched to the pipe or nozzle diameter, which is the inner diameter of the body 20 within which it must fit, as shown in FIG. 3.

The center vane 30 is provided with three skewed channels or slots which are rotationally symmetric around the vane axis with respect to one another. Channels or slots are located 120° from one another around the axis of vane 30.

The input and output face sides of center vane 30, as seen respectively in FIGS. 4 and 7, are parallel to each other, as seen in FIGS. 5 and 6.

In order to cause the nozzle 30 to retain the characteristics of a solid, uniform spray cone for varying input fluid pressures, varying volumetric flow and varying diameters, the following parameters were analyzed and the following critical values were discovered:

(1) NUMBERS OF SLOTS

It was found critical that only three channels or slots be used which are of rectangular cross-section configuration. Three slots were found to be ideal for the center vane 30 since fewer (one or two) larger area slots reduce the effect of distribution of water, and thus reduce the ability of the center vane to swirl water to form the uniform distribution within a solid spray cone. A larger number of slots (four or five) was disadvantageous since each slot has smaller areas which are more likely to become clogged and are difficult to manufacture. Thus, the use of three slots is of significance to the design of the novel center vane.

(2) SLOT GEOMETRY

A slot geometry was selected which employs the generally rectangular cross-section as seen in FIG. 8. The width of the slots is made equal to one-fourth (0.25) times the diameter of the center vane or nozzle diameter. This slot width is shown in FIGS. 6 and 8 where it can be seen that the slots have a flat square bottom.

(3) SLOT DEPTH

The slot depth, as measured at the input face of FIG. 4, is one-third (0.33) times the nozzle diameter.

(4) VANE LENGTH

The total vane length shown in FIGS. 3, 5 and 6 has been found preferably to be one-half (0.5) times the pipe or nozzle diameter.

(5) SLOT ANGLE

The angle of any of the slots relative to the vane axis is equal to one-half (0.5) times the desired spray angle, as seen in FIG. 3. Thus, a spray angle of 90° would have a slot angle of 45°. However, we have found that it is also possible to change the spray angle by modifying the exit flare of the nozzle.

(6) VANE RECESS

The center vane recess provides the means whereby the fluid can be properly distributed so that a solid spray cone will result. It has been found that the recess is a very critical dimension and if not properly calculated can result in an uneven distribution of fluid particles in the cross-section of the cone spray. It has been found that if the orifice diameter is equal to or greater than one-half (0.5) the nozzle diameter, then the vane recess depth should be equal to one-fourth (0.25) the nozzle diameter or pipe diameter. However, if the orifice diameter is less than half the nozzle diameter, too much fluid from the slots is moved into the center of the recess. Hence, it is necessary to reduce the depth of the recess under these conditions. This is achieved by following the following relation. If the orifice diameter is less than one-half (0.5) the nozzle diameter or pipe diameter, then the vane recess depth should vary as the square of the orifice diameter divided by the pipe or nozzle diameter.

(7) AXIAL DISPLACEMENT OF VANE TO ORIFICE

The axial displacement between the outlet side of the center vane and the start of the slopes or tapper 26 to the orifice 21, as seen in FIG. 3, should be equal to the nozzle diameter. Thus, a cross-section in a plane that is in the path of the flow of the fluid (i.e. the sheet of paper as seen in FIG. 3) would be substantially a square.

As was previously described, center vane 30 can be either plastic or metal or other materials. When the conduit connected to the threads 22 is also of metal, its inner diameter closely matches the inner diameter of housing 20 and thus the outer diameter of vane 30. However, when plastic pipe is employed and connected to threads 22, the plastic pipe inner diameter may be slightly smaller than the outer diameter of vane 30 so that there is a small flow discontinuity at the point where the conduit ends and the vane surface begins. However, if vane, nozzle body and conduit or pipe are all made of plastic, there is no discontinuity.

As seen in FIGS. 1 to 8, the following terms and abbreviations will be used throughout the specification and claims:

N DIAM=nozzle diameter
P DIAM=pipe diameter
O DIAM=orifice diameter
V DIAM=center vane diameter
VR DIAM=vane recess diameter
VR DEPTH=vane recess depth
V LENGTH=vane length
S SPACING=slot spacing
S WIDTH=slot width
S ANGLE=slot angle
S DEPTH=slot depth
A LENGTH=axial length
PSI=pound per square inch
GPM=gallons per minute Each vane is designed according to a basic formula that bears a relation to the pipe size and orifice diameter. We have found that we can achieve optimum conditions for a uniform distribution of full cone spray by providing the center vane with three slots that are spaced circumferentially from each other by 120° as seen in FIGS. 4 and 7. Each slot is cut at an angle to the axis of the vane which is one-half the desired spray angle. The depth of the slot is equal to one-third of pipe size. The following relations will hold true.

V LENGTH=0.5 N DIAM=0.5 P DIAM
V DIAM=N DIAM=P DIAM
VR DIAM=0.5 N DIAM=0.5 P DIAM
A LENGTH=N DIAM=P DIAM
S SPACING=120° from each other
S ANGLE=0.5 times desired spray angle
S WIDTH=0.25 N DIAM
S DEPTH=0.33 P DIAM Usually the VR DEPTH is equal to 0.25 P DIAM. This relation of VR DEPTH being one-fourth the pipe size works well when the size of the O DIAM is equal to or greater than 0.5 P DIAM.

If O DIAM$\geqq$0.5 P DIAM,
then VR DEPTH=0.25 P DIAM.
But if O DIAM$<$0.5 P DIAM,
then VR DEPTH=$(\text{O DIAM})^2/\text{P DIAM}$ Thus, we have found that for the above relation, the dimensions of the VR DEPTH are critical to the distribution of the fluid particles. If the VR DEPTH were as large as 0.25 of the P DIAM when the O DIAM is less than 0.5 P DIAM, then there is too much fluid in the center of the stream and, hence, one does not obtain a uniform distribution full cone spray. That is, when the O DIAM is half or more of the N DIAM and the center vane is designed so that the VR DEPTH is one-fourth (0.25) of the N DIAM, then there is a good distribution of fluid particles so that a uniform distribution full cone spray will result. However, it has been found that if the VR DEPTH is one fourth (0.25) of the O DIAM when the O DIAM is less than one-half the N DIAM, there is too much fluid in the center of the spray cone and there is not a uniform distribution full cone. A typical situation for a one inch nozzle in which the VR DEPTH is equal to one-fourth of the O DIAM is as follows:

| PIPE SIZE | O DIAM | VR DEPTH | CONDITION AT CENTER OF CONE |
|---|---|---|---|
| 1.00 | 0.25 | 0.25 | too much fluid |
| 1.00 | 0.50 | 0.25 | correct amount |
| 1.00 | 0.75 | 0.25 | correct amount |

Thus, we have found that when the O DIAM is less than one-half the P DIAM, then VR DEPTH should be less than one-fourth the P DIAM, i.e. O DIAM$<$0.5 P DIAM, then VR DEPTH$<$0.25 O DIAM. However, when the O DIAM is equal to or greater than one-half the P DIAM, then VR DEPTH is still equal to one-fourth (0.25) P DIAM, i.e. O DIAM$\geqq$0.5 P DIAM, then VR DEPTH$=$0.25 P DIAM.

In order to create a uniform distribution full cone spray, we have found that the correct relation (in inches) between the VR DEPTH and the O DIAM, when the O DIAM$<$0.5 P DIAM, is VR DEPTH$=0.75(\text{O DIAM})^2/\text{P DIAM}$ rather than$=$0.25 P DIAM. Thus, a uniform distribution of full cone spray pattern is obtained in the following arrangement.

| PIPE SIZE | O DIAM | VR DEPTH | FULL cone |
|---|---|---|---|
| 1.00 | 0.25 | 0.0625 | uniform distribution |
| 1.00 | 0.50 | 0.250 | uniform distribution |
| 1.00 | 0.75 | 0.250 | uniform distribution |

As previously pointed out, the novel design of the present invention permits the use of the same geometry for a wide range of pipe sizes and for a wide range of pressures and volumetric flows. There follows a table showing the parameters of a vane design for pipe sizes varying from 1 inch internal diameter to 4 inches internal diameter. Note that the vane can be used in pipes smaller than 1 inch internal diameter and larger than 4 inches internal diameter while retaining the solid spray cone. The following table gives, in inches, the various parameters. Thus, typical dimension relations with the present invention would be as follows:

| PSI | GMP | VANE DIAM NOZZLE DIAM | ORIFICE DIAM | VANE RECESS DIAM | VANE RECESS DEPTH | SPRAY ANGLE | VANE LENGTH |
|---|---|---|---|---|---|---|---|
| 40 | 10 | 1.0 | 0.25 | 0.5 | .063 | 55 | 0.5 |
| 40 | to | 1.0 | 0.50 | 0.5 | .250 | to | 0.5 |
| 40 | 25 | 1.0 | 0.75 | 0.5 | .250 | 95 | 0.5 |
| 40 | 15 to | 1.25 | 0.313 | 0.625 | 0.078 | 55 to | 0.625 |
| 40 | 45 | 1.25 | 0.625 | 0.625 | 0.313 | 90 | 0.625 |
| 40 | 20 to | 1.5 | 0.375 | 0.75 | 0.094 | 52 to | 0.75 |
| 40 | 70 | 1.5 | 0.75 | 0.75 | 0.375 | 90 | 0.75 |
| 40 | 40 | 2 | 0.375 | 1.0 | 0.070 | 50 | 1.0 |
| 40 | to | 2 | 0.50 | 1.0 | 0.125 | to | 1.0 |
| 40 | 140 | 2 | 1.00 | 1.0 | 0.500 | 97 | 1.0 |
| 40 | 60 to | 2.5 | 0.625 | 1.25 | 0.156 | 50 to | 1.25 |
| 40 | 210 | 2.5 | 1.250 | 1.25 | 0.625 | 85 | 1.25 |
| 40 | 100 | 3.0 | 0.50 | 1.5 | 0.083 | 45 | 1.5 |
| 40 | to | 3.0 | 0.75 | 1.5 | 0.188 | to | 1.5 |
| 40 | 280 | 3.0 | 1.50 | 1.5 | 0.750 | 90 | 1.5 |
| 40 | 365 | 4.0 | 0.75 | 2.0 | 0.141 | 75 | 2.0 |
| 40 | to | 4.0 | 1.0 | 2.0 | 0.250 | to | 2.0 |
| 40 | 485 | 4.0 | 2.0 | 2.0 | 1.000 | 80 | 2.0 |

Each of the parameters was calculated on the basis of the relationships given above and apply to a vane employing three slots.

Although the present invention has been described in connection with a preferred embodiment thereof, variations and modifications may become apparent to those skilled in the art. It is preferred that the present invention be limited, not by the specific disclosure contained herein, but by the appended claims.

What is claimed is:

1. In a in-line full cone spray nozzle, a nozzle body having an elongated generally cylindrical internal chamber therein, one end of which chamber constitutes an inlet end through which liquid may pass into said chamber, a center vane disposed in said chamber adjacent to said inlet end for imparting swirling and turbulent motion to liquid advancing through said chamber, said chamber at its other end being gradually reduced in diameter and terminating in an end wall having a discharge orifice coaxial with said chamber, said center vane having (1) a diameter equal to the inside diameter of the nozzle;

(2) a length equal to one-half the inside diameter of the nozzle;

(3) a recess at the output end being in the form of a hollow cylinder and (a) being concentric to the axis of the center vane;

(b) extending from the output end toward the input end;

(c) having a depth from the output end toward the input end equal to one-fourth (0.25) of the inside nozzle diameter when the orifice diameter is equal to and greater than one-half (0.5) the nozzle diameter;

(d) having a diameter equal to one-half (0.5) the nozzle diameter;

(4) at least three slots symmetrically disposed, extending into the out periphery of the center vane, with each slot having substantially identical configuration to the other with a rectangular cross-section with parallel walls and a flat bottom having;

(a) a width equal to one-fourth (0.25) the inside diameter of the center vane;

(b) a depth equal to the inside diameter of the nozzle divided by the number of slots;
(c) the bottom of the slots at the output end communicating with the recess; and
(d) each slot disposed at an angle to the vane axis thereby twirling fluid around the vane axis.

2. The nozzle of claim 1, in which the vane recess at the discharge end permits some of the fluid entering the slots to be directed inwardly toward the center to thereby create a solid cone to be discharged from the orifice.

3. A center vane for a straight-through pipe solid cone nozzle in which a given geometry produces a uniform spray distribution in a solid cone regardless of difference in fluid pressure, volumetric flow of fluid and pipe diameter; said center vane comprising a cylindrical body which is rotationally symmetric about a central axis and has spaced, parallel input and output faces which are perpendicular to said axis; said center vane having a circular outer periphery which has a diameter substantially equal to the internal diameter of said straight-through pipe; said vane having a recess at the output end being in the form of a hollow cylinder and
(a) being concentric to the axis of the center vane;
(b) extending from the output end toward the input end;
(c) having a depth from the output end toward the input end equal to one-fourth (0.25) of the inside nozzle diameter when the orifice diameter is equal to and greater than one-half (0.5) the nozzle diameter;
(d) having a diameter equal to one-half (0.5) the nozzle diameter;

at least three slots symmetrically disposed, extending into the out periphery of the center vane, with each slot having substantially identical configuration to the other with a rectangular cross-section with parallel walls and a flat bottom at the inlet end in a plane parallel to the central axis of the center vane and having
(a) a width equal to one-fourth (0.25) the inside diameter of the center vane;
(b) a depth equal to the inside diameter of the nozzle divided by the number of slots;
(c) the bottom of the slots at the output end communicating with the recess;
(d) each slot disposed at an angle to the vane axis thereby twirling fluid around the vane axis;

said vane having a smaller open cross-sectional area at said input upstream face of said vane than at said output downstream face of said vane.

4. The center vane of claim 3, wherein an angle between said slots and said vane axis is substantially less than 90°.

5. The center vane of claim 3, wherein said vane has a length equal to one-half (0.5) times said nozzle diameter.

6. The center vane of claim 4, wherein said vane has a length equal to one-half (0.5) times said nozzle diameter.

7. The center vane of claim 3, wherein said flat bottoms of said slots terminate at the start of the recess located at the output end.

8. The spray nozzle of claim 1, in which the outlet surface of the vane is spaced from the start of the slope of the output orifice by a distance equal to the nozzle diameter.

9. The center vane of claims 3, 4, 5, 6, or 7, in which each of said recesses has a depth from the outlet side of said center vane equal to 0.25 the nozzle diameter when the orifice diameter is equal to or greater than one-half (0.5) the nozzle diameter and equal to the orifice diameter squared divided by the nozzle diameter when the orifice diameter is less than half (0.5) of the nozzle diameter.

10. A recessed center vane for a straight-through solid cone nozzle, in which
(1) the vane length is equal to one-half (0.5) times the nozzle diameter;
(2) the vane diameter is equal to the nozzle diameter;
(3) a recess at the output end being in the form of a hollow cylinder and
(a) being concentric to the axis of the center vane;
(b) extending from the output end toward the input end;
(c) having a depth from the output end toward the input end equal to one-fourth (0.25) of the inside nozzle diameter when the orifice diameter is equal to and greater than one-half (0.5) the nozzle diameter;
(d) having a diameter equal to one-half (0.5) the nozzle diameter;
(4) at least three slots symmetrically disposed, extending into the out periphery of the center vane, with each slot having substantially identical configuration to the other with a rectangular cross-section with parallel walls and a flat bottom having;
(a) a width equal to one-fourth (0.25) the inside diameter of the center vane;
(b) a depth equal to the inside diameter of the nozzle divided by the number of slots;
(c) the bottom of the slots at the output end communicating with the recess; and
(d) each slot disposed at an angle to the vane axis thereby twirling fluid around the vane axis.

11. The recessed center vane of claim 1, 3 or 10 for use with nozzle diameters from 0.125 to 24.0 inches in which the range of fluid flow and pressure is between 1 and 15,000 g.p.m. and 1 to 150 p.s.i., respectively.

12. In a in-line full cone spray nozzle, a nozzle body having an elongated generally cylindrical internal chamber therein, one end of which chamber constitutes an inlet end through which liquid may pass into said chamber, a center vane disposed in said chamber adjacent to said inlet end for imparting swirling and turbulent motion to liquid advancing through said chamber, said chamber at its other end being gradually reduced in diameter and terminating in an end wall having a discharge orifice coaxial with said chamber, said center vane having
(1) a diameter equal to the inside diameter of the nozzle;
(2) a length equal to one-half the inside diameter of the nozzle;
(3) a recess at the output end being in the form of a hollow cylinder and
(a) being concentric to the axis of the center vane
(b) extending from the output end toward the input end
(c) having a depth from the output end toward the input end equal to orifice diameter squared divided by the nozzle diameter when the orifice diameter is equal to and smaller than one-half (0.5) the nozzle diameter (4) at least three slots symmetrically disposed, extending into the out periphery of the center vane, with each slot having substantially identical configuration to the other with a rectangular cross-section with parallel walls and a flat bottom having
(a) a width equal to one-fourth (0.25) the inside diameter of the center vane
(b) a depth equal to the inside diameter of the nozzle divided by the number of slots
(c) the bottom of the slots at the output end communicating with the recess
(d) each slot disposed at an angle to the vane axis thereby twirling fluid around the vane axis.

13. A center vane for a straight-through pipe solid cone nozzle in which a given geometry produces a uniform spray distribution in a solid cone regardless of difference in fluid pressure, volumetric flow of fluid and pipe diameter; said center vane comprising a cylindrical body which is rotationally symmetric about a central axis and has spaced parallel input and output faces which are perpendicular to said axis; said center vane having a circular outer periphery which has a diameter substantially equal to the internal diameter of said straight-through pipe; said vane having a recess at the output end being in the form of a hollow cylinder and
(a) being concentric to the axis of the center vane
(b) extending from the output end toward the input end
(c) having a depth from the output end toward the input end equal to orifice diameter squared divided by the nozzle diameter when the orifice diameter is equal to and smaller than one-half (0.5) the nozzle diameter at least three slots symmetrically disposed, extending into the out periphery of the center vane, with each slot having substantially identical configuration to the other with a rectangular cross-section with parallel walls and a flat bottom at the inlet end in a plane parallel to the central axis of the center vane and having
(a) a width equal to one-fourth (0.25) the inside diameter of the center vane
(b) a depth equal to the inside diameter of the nozzle divided by the number of slots
(c) the bottom of the slots at the output end communicating with the recess
(d) each slot disposed at an angle to the vane axis thereby twirling fluid around the vane axis.

14. A recessed center vane for a straight-through solid cone nozzle, in which
(1) the vane length is equal to one-half (0.5) times the nozzle diameter;
(2) the vane diameter is equal to the nozzle diameter;
(3) a recess at the output end being in the form of a hollow cylinder and
(a) being concentric to the axis of the center vane
(b) extending from the output end toward the input end
(c) having a depth from the output end toward the input end equal to orifice diameter squared divided by the nozzle diameter when the orifice diameter is equal to and smaller than one-half (0.5) the nozzle diameter
(4) at least three slots symmetrically disposed, extending into the out periphery of the center vane, with each slot having substantially identical configuration to the other with a rectangular cross-section with parallel walls and a flat bottom having
(a) a width equal to one-fourth (0.25) the inside diameter of the center vane
(b) a depth equal to the inside diameter of the nozzle divided by the number of slots
(c) the bottom of the slots at the output end communicating with the recess
(d) each slot disposed at an angle to the vane axis thereby twirling fluid around the vane axis.

* * * * *